US005888565A

United States Patent [19]

Gics

[11] Patent Number: 5,888,565

[45] Date of Patent: Mar. 30, 1999

[54] FOOD PACKAGE INCLUDING A TRAY WITH COVER MEMBER HAVING A RAISED TOP SURFACE

[75] Inventor: Paul W. Gics, Sewickley Heights, Pa.

[73] Assignee: Gics & Vermee, L.P., Sewickley, Pa.

[21] Appl. No.: 977,418

[22] Filed: Nov. 24, 1997

[51] Int. Cl.[6] ..... B65D 5/04

[52] U.S. Cl. ..... 426/124; 426/113; 426/87; 426/398; 220/635; 206/462; 206/769

[58] Field of Search ..... 426/124, 106, 426/113, 398, 87; 220/631, 635; 206/461, 462, 779, 784, 769

[56] References Cited

U.S. PATENT DOCUMENTS

| | | | |
|---|---|---|---|
| 2,713,451 | 7/1955 | Williamson et al. | 206/779 |
| 2,904,170 | 9/1959 | Hennessey et al. | 229/103.2 |
| 3,160,326 | 12/1964 | Sturdevant et al. . | |
| 3,685,649 | 8/1972 | Diehl | 206/769 |
| 3,904,104 | 9/1975 | Kane | 229/3.5 |
| 3,938,730 | 2/1976 | Detzel et al. | 229/43 |
| 4,705,172 | 11/1987 | Gane | 206/519 |
| 5,011,006 | 4/1991 | Anderson | 206/45.24 |
| 5,119,940 | 6/1992 | Grindrod . | |
| 5,247,149 | 9/1993 | Peleg . | |
| 5,492,703 | 2/1996 | Gics | 206/459.5 |
| 5,540,381 | 7/1996 | Davis | 229/103.2 |

*Primary Examiner*—David Lacey
*Assistant Examiner*—Hao Mai
*Attorney, Agent, or Firm*—David V. Radack; Benjamin T. Queen, II; Eckert Seamans Cherin & Mellott, LLC

[57] ABSTRACT

A food package including a tray and a sleeve surrounding the tray where the tray includes a rigid cover member secured thereto. The rigid cover member includes a first top surface and a second top surface elevated above the first top surface. The sleeve includes a front panel having an opening formed therein. The front panel of the sleeve is disposed adjacent the first top surface of the rigid cover member and the second top surface is received in the opening formed in the front panel so as to effectively retain the tray within the sleeve.

17 Claims, 4 Drawing Sheets

FOOD PACKAGE INCLUDING A TRAY WITH COVER MEMBER HAVING A RAISED TOP SURFACE

BACKGROUND OF THE INVENTION

This invention relates to a food package including a tray with a rigid cover member having a raised top surface for securing the tray within the food package.

Food packaging for fresh items, such as, for example, meat and pastry products, among other things, may be provided in various ways. One such way, as disclosed in my commonly owned U.S. patent application Ser. No. 08/819,889, filed Mar. 18, 1997, is to provide a tray for holding the fresh item and a sleeve disposed about the tray. As can be appreciated, the tray maintains the freshness of the item contained therein, preferably by having a plastic film sealed thereto, and the sleeve provides an attractive facing and sufficient labeling space.

However, there are several aspects of such a food packaging which may be improved so as to increase overall quality and customer satisfaction. For example, it is often advantageous to be able to remove the tray from the sleeve and then reinsert the tray within the sleeve, repeatedly if desired, for storage purposes, for example. In this case, it is essential that a means be provided for easily securing the tray to the sleeve and for easily unsecuring the tray from the sleeve as well. Another area for improvement for food packaging containing fresh items, is to provide a means for viewing or visually inspecting the item contained within the tray prior to opening or purchasing the item.

What is needed, therefore, is a food package which provides a sleeve disposed about a tray where the tray can be conveniently retained within the sleeve while also providing for viewing or visual inspection of the item contained within the tray prior to opening or purchasing of the food package.

SUMMARY OF THE INVENTION

The food package of the present invention has met or exceeded the above-mentioned needs, as well as others. The food package comprises a tray including a base and a sidewall extending from the base. The food package also comprises a rigid cover member which is secured to the tray. Specifically, the rigid cover member includes a first top surface and a second top surface elevated above the first top surface. The food package further comprises a sleeve surrounding the tray where the sleeve includes a front panel having an opening formed therein. The front panel of the sleeve is disposed adjacent the first top surface and the second top surface is received in the opening. Advantageously, receipt of the second top surface within the opening effectively provides for mechanically retaining the tray within the sleeve.

The rigid cover member also includes a pilot surface which extends between the first top surface and the second top surface. Preferably, the pilot surface extends generally angularly upwardly and inwardly from the first top surface to the second top surface so as to easily allow for the second top surface to be received within or removed from the opening formed in the front panel of the sleeve. Preferably, the second top surface is transparent for viewing or visually inspecting the contents of the tray.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
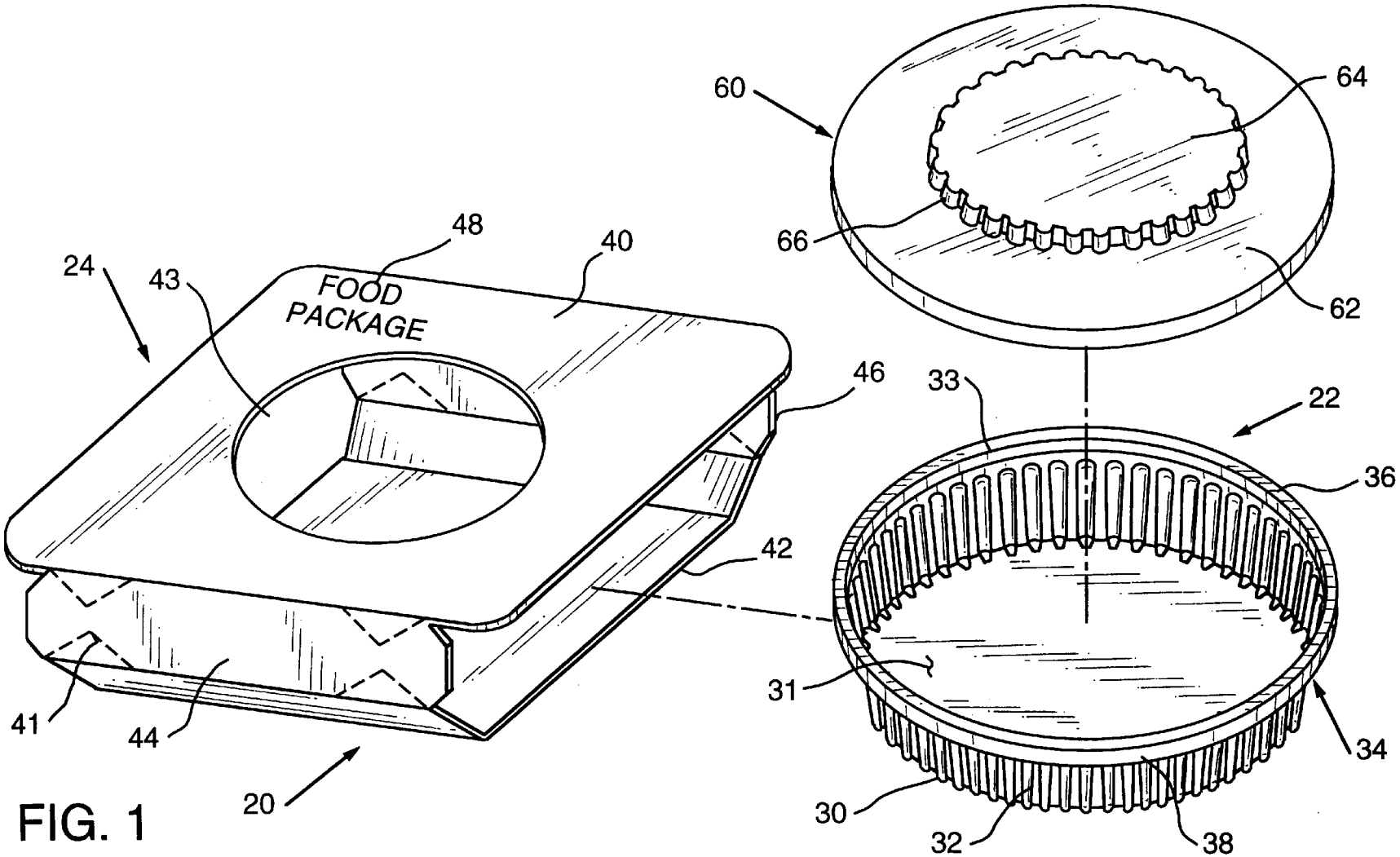
FIG. 1 is an exploded perspective view of one embodiment of the food package of the present invention.
Figure 2:
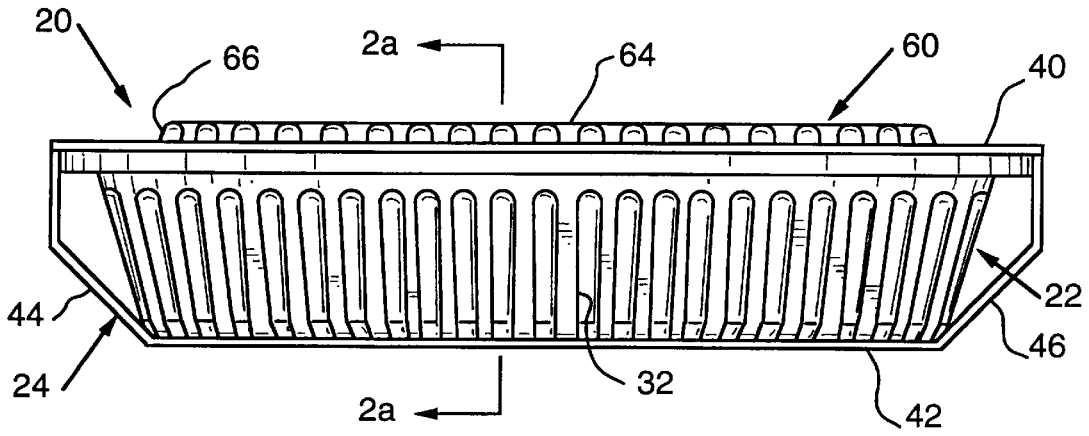
FIG. 2 is a side elevational view of the food package of FIG. 1 as assembled.
Figure 2A:
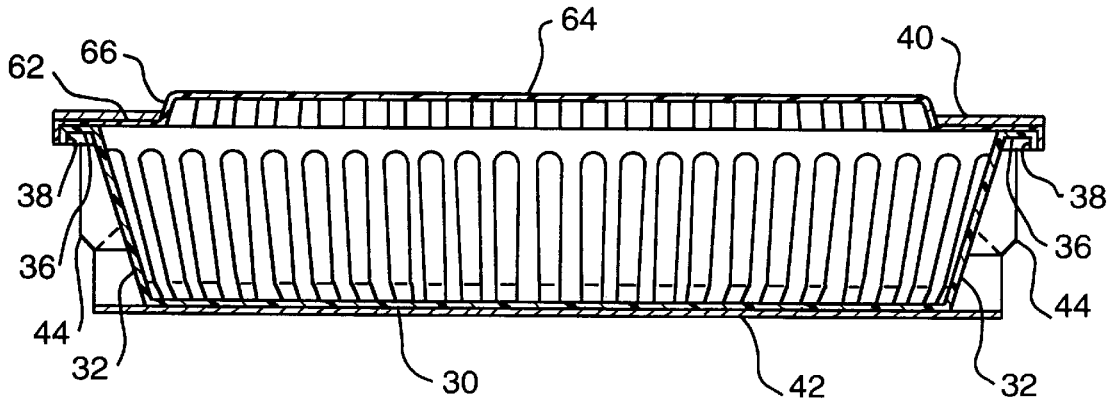
FIG. 2*a* is a sectional view taken along line 2*a*—2*a* of FIG. 2.

Referring now to FIGS. 1, 2 and 2*a*, a preferred embodiment of a food package 20 of the present invention is shown. The food package 20 consists of a tray 22 and a sleeve 24. The tray 22 can be made of any suitable material, however, it is preferred that the tray 22 be made of a plastic. Most preferably, the plastic is crystallized polyethylene terephlalate ("C-PETE") although other plastics, such as, amorphus polyethylene terephlalate ("A-PETE") or polypropylene may be used. The sleeve 24 can also be made of any suitable material, but preferably is made of paperboard.

The plastic tray 22 has a base 30 and a sidewall 32 extending from the base 30. The sidewall 32 of tray 22 terminates in a free edge 33 which defines a tray opening 31. It will be appreciated that tray 22 may be of the shape as shown in FIGS. 1–2 or any other shape, such as, rectangular or oval depending on both functional and aesthetic requirements. The sidewall 32 includes a flange 34 having a first section 36 extending generally perpendicularly from the sidewall 32 and a second section 38 extending generally perpendicularly from the first section 36.

It is preferred that the plastic tray 22 be integrally formed by a molding process, although the tray 22 may be made as separate components and secured together in order to form the tray 22. Although flange 34 is shown as extending from an outer portion of the free edge 33 of sidewall 32, it will be appreciated that flange 34 may be positioned and extend from sidewall 32 at any point along the height of sidewall 32.

The sleeve 24 includes a front panel 40 and a back panel 42. The front panel 40 includes an opening 43 formed therein which aids in retaining the tray 22 within the sleeve 24, as will be described in more detail below. Sleeve 24 also includes a pair of sidewall members 44,46 extending between the front panel 40 and the back panel 42. Tear strip 41 may be provided on sidewall member 44, or other similar location, so that sidewall member 44 may be separated from front panel 40 and back panel 42 so as to expose tray 22. Preferably, the sleeve 24 is continuous and encircles tray 22 once tray 22 is inserted therein.

Indicia such as the words "FOOD PACKAGE" 48 may be printed or otherwise disposed on the front panel 40. It will be appreciated that the indicia can also include pleasing graphics or colors to make the package 20 more attractive to a potential consumer. In addition, back panel 42 may be used to place other indicia, such as "NUTRITIONAL INFORMATION" 50, which may be mandated by local food labeling laws, as well as, "COOKING INSTRUCTIONS" 52, which may be desired to be placed on the food package 20 (not shown in FIGS. 1–2, but see embodiment set forth in FIG. 4*a*). In this way, the more prosaic information either required or desired to be placed on the sleeve 24 can be printed on the back panel 42, leaving the front panel 40 free for containing more eye-catching graphics and colors.

In accordance with an important aspect of the present invention, the tray 22 also includes a rigid cover member 60 which is secured to the tray 22. The rigid cover member 60 is secured to the tray 22 in order to keep items contained within the tray 22 fresh. The rigid cover member 60 may be secured to the tray 22 in any manner as is known, but preferably by snap-fit engagement between the rigid cover member 60 and the flange 36 of the tray 22.

The rigid cover member 60 includes a first top surface 62 and a second top surface 64 elevated above the first top surface 62. Once the food package 20 is assembled, see FIG. 2, the front panel 40 of the sleeve 24 is disposed adjacent to the first top surface 62. Additionally, the second top surface 64 is received in the opening 43 formed in the front panel 40 of sleeve 24. Advantageously, receipt of the second top surface 64 in the opening 43 effectively provides for mechanically retaining the tray 22 within the sleeve 24, without the need for heat sealing or adhesives. As best shown in FIG. 2, the second top surface 64 preferably protrudes through the opening 43 so that a pilot surface 66, which extends between the first top surface 62 and the second top surface 64, is in contact with the perimeter of the opening 43. As can be appreciated, placement of the food package 20 in various positions, such as upright or angularly, can be accomplished while maintaining the tray 22 within the sleeve 24 as a result of the second top surface 64 being received in the opening 43, and particularly as a result of the cooperation between the pilot surface 66 and the perimeter of the opening 43.

Preferably, the pilot surface 66 extends generally angularly upwardly and inwardly from the first top surface 62 to the second top surface 64. This enables the second top surface 64 to be more easily received within the opening 43 of sleeve 24. Additionally, the generally angularly upwardly pilot surface 66 also allows for the first top surface 64 to be easily withdrawn from the opening 43 so that the tray 22 may be removed from the sleeve 24. Thus, the ability to easily receive and withdraw the first top surface 64 is advantageous for uses, for example, where the tray 22 must be removed from the sleeve 24 and then reinserted in the sleeve 24 for storage purposes, for example.

Preferably, the second top surface 64 is transparent so as to provide for viewing or visual inspection of the contents of the tray opening 31. The ability to view or visually inspect the contents of the tray opening 31 is important, for example, when the tray 22 contains fresh items, such as, meat and pastry products.

The rigid cover member 60 is preferably made of, for example, a clear plastic.

Figure 3:
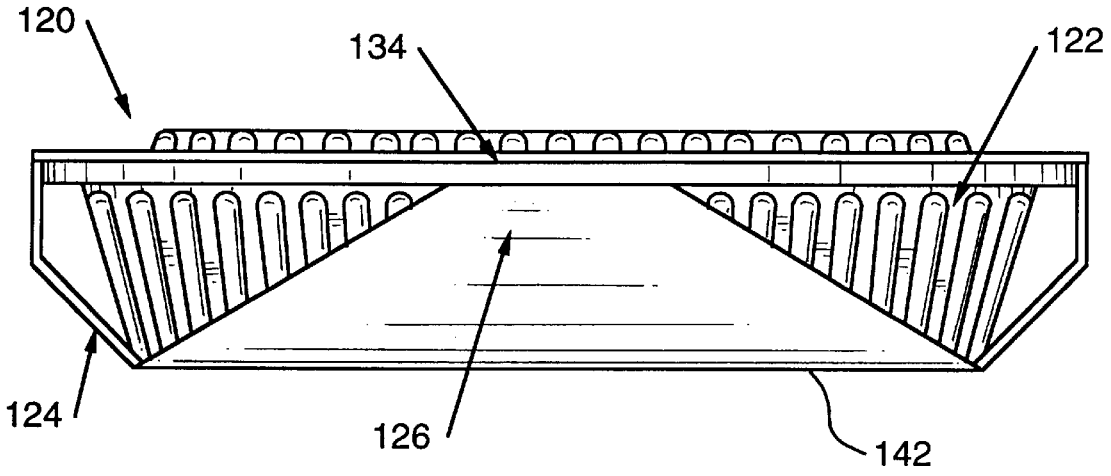
FIG. 3 is a side elevational view of another embodiment of the present invention.

With reference to FIG. 3, there is shown another embodiment of the present invention. This embodiment sets forth a food package 120 that is similar to food package 20 described herein and set forth in FIGS. 1, 2 and 2*a* except that sleeve 124 includes end flap 126 which, preferably, extends from the back panel 142. An additional end flap may be provided on the opposing end of sleeve 124 but is not shown in FIG. 3. End flap 126, as well as the end flap not shown, are mechanically secured to the flange 134 of tray 122 so as to further enhance the retention of the tray 122 within sleeve 124. A complete description of the cooperation between end flap 126 of sleeve 124 and the flange 134 of tray 122 is provided in my commonly owned U.S. patent application Ser. No. 08/958,920 (Ser. No. not yet received), filed Oct. 28, 1997, the complete disclosure of which is incorporated herein by reference.

Figure 4:
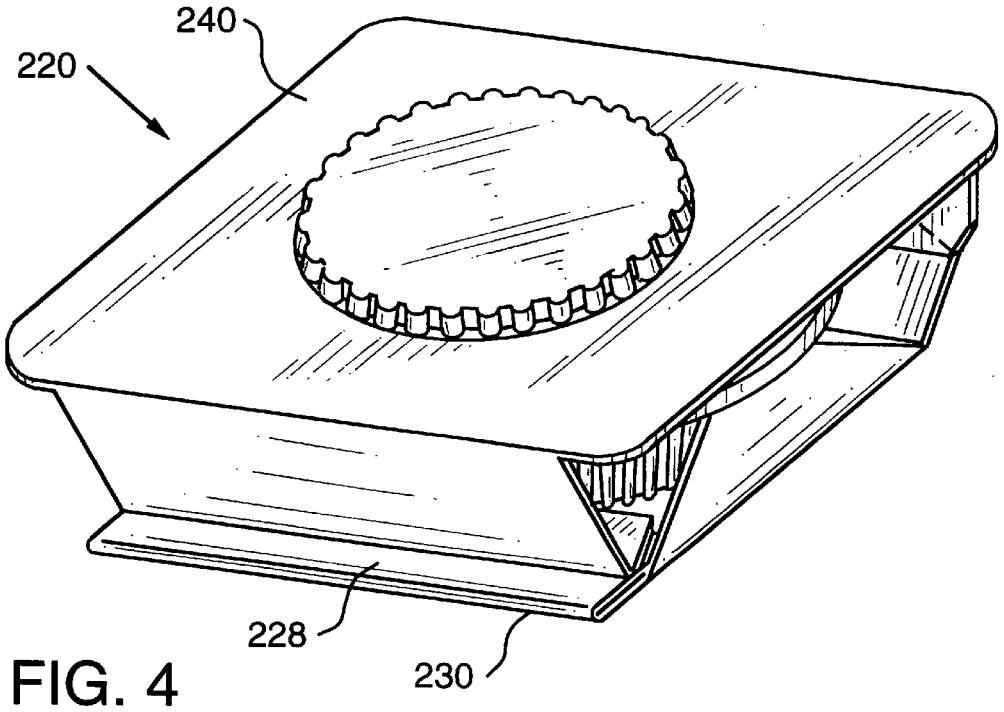
FIG. 4 is a perspective view of a further embodiment of the present invention.
Figure 4A:
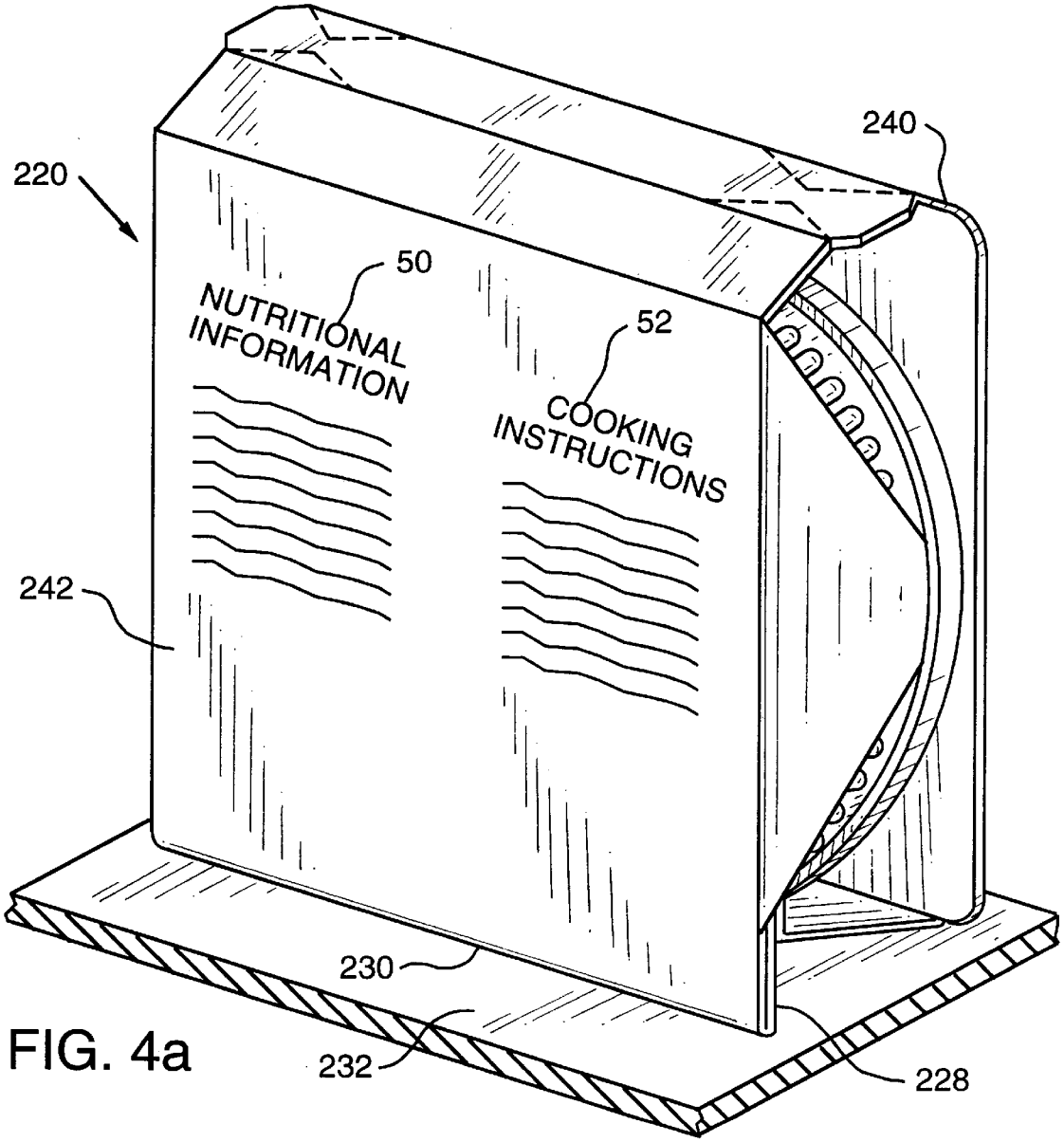
FIG. 4*a* is a perspective view showing the food package of FIG. 4 as "stood up" in an upright position.

Referring to FIGS. 4 and 4*a*, an additional embodiment of the present invention is shown. Food package 220 is similar to the food package 20 as described herein and set forth in FIGS. 1, 2 and 2*a* except that food package 220 includes a rigid leg member 228 which extends from the back panel 242 and includes a bottom edge 230 that is adapted to rest on a support surface 232, so as to position the food package 220 substantially perpendicular to the support surface 232. Advantageously, this allows for the front panel 240 and back panel 242 to be displayed to potential customers. Further details concerning the rigid leg member 228 are set forth in commonly owned U.S. patent application Ser. No. 08/883,062, filed Jun. 26, 1997, the disclosure of which is expressly incorporated herein by reference.

It will be appreciated that a food package has been disclosed which effectively provides for mechanically retaining a tray within a sleeve which is disposed thereabout without the need for heat sealing or adhesives. The receipt of the second top surface of the rigid cover member within the opening formed in the front panel of the sleeve effectively provides for retaining the tray within the sleeve. Additionally, the second top surface being preferably transparent allows for consumers to view or visually inspect the food items contained within the tray. As an additional means for retaining the tray within the sleeve, the sleeve may include one or more end flaps which are mechanically secured to the tray. The sleeve may also include a rigid leg member so that the food package may be "stood up."

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A food package comprising:

a tray including a base and a sidewall extending from said base;

a rigid cover member secured to said tray, said rigid cover member including (i) a first top surface; (ii) a second top surface elevated above said first top surface; (iii) and a pilot surface extending between said first top surface and said second top surface; and a sleeve surrounding said tray, said sleeve including a front panel having an opening defined by an edge, said front panel disposed adjacent said first top surface and said second top surface being received in said opening with a portion of said edge of said opening engaging a portion of said pilot surface in order to retain said tray and said cover member in said sleeve.

2. The food package of claim 1 wherein said pilot surface extends generally angularly upwardly and inwardly from said first top surface to said second top surface.

3. The food package of claim 2 wherein said sidewall terminates in a free edge, said free edge defining a tray opening.

4. The food package of claim 3 wherein said second top surface is transparent for viewing said tray opening.

5. The food package of claim 1 wherein at least a portion of said sidewall includes a flange extending therefrom, said rigid cover member being secured to said flange.

6. The food package of claim 5 wherein said rigid cover is secured to said flange by snap-fit engagement therewith.

7. The food package of claim 5 wherein said sleeve surrounding said tray includes at least one end flap mechanically secured to said flange.

8. The food package of claim 1 wherein said sleeve includes a back panel disposed adjacent to said base of said tray.

9. The food package of claim 8 further including a rigid leg member extending from said back panel, said rigid leg member having a bottom edge that can rest on a support surface in order to position said front panel substantially perpendicularly to said support surface, whereby said display surface can be better seen by potential customers.

10. The food package of claim 8 wherein said back panel includes nutrition information and cooking instruction indicia printed thereon.

11. The food package of claim 1 wherein said front panel includes food product identification indicia printed thereon.

12. The food package of claim 1 wherein said tray is composed of a plastic.

13. The food package of claim 12 wherein said plastic is crystallized polyethylene terephlalate.

14. The food package of claim 12 wherein said plastic is amorphous polyethylene terephlalate.

15. The food package of claim 12 wherein said plastic is polypropylene.

16. The food package of claim 1 wherein said sleeve includes a tear strip.

17. The food package of claim 1 wherein said sleeve is continuous and encircles said tray.

* * * * *

UNITED STATES PATENT AND TRADEMARK OFFICE

CERTIFICATE OF CORRECTION

PATENT NO. : 5,888,565
DATED : March 30, 1999
INVENTOR(S) : Paul W. Gics

It is certified that error appears in the above-identified patent and that said Letters Patent is hereby corrected as shown below:

Cover page, References Cited, Column 2, third name "Gane", should read –Gage—

Column 3, line 65, the parenthetical phrase "(Ser. No. not yet received)", should read --Serial No. 08/958,920--

Signed and Sealed this

Fourth Day of April, 2000

*Attest:*

*Attesting Officer*

Q. TODD DICKINSON

*Director of Patents and Trademarks*